US009787023B2

(12) United States Patent
Nakazawa

(10) Patent No.: US 9,787,023 B2
(45) Date of Patent: Oct. 10, 2017

(54) CONNECTOR AND CONNECTOR ASSEMBLY WITH TOUCH ROTECTION FEATURE

(71) Applicant: JAPAN AVIATION ELECTRONICS INDUSTRY, LIMITED, Shibuya-ku, Tokyo (JP)

(72) Inventor: Katsuhiko Nakazawa, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/352,863

(22) Filed: Nov. 16, 2016

(65) Prior Publication Data

US 2017/0194740 A1 Jul. 6, 2017

(30) Foreign Application Priority Data

Jan. 5, 2016 (JP) ..... 2016-000359

(51) Int. Cl.
*H01R 13/62* (2006.01)
*H01R 13/627* (2006.01)
(Continued)

(52) U.S. Cl.
CPC ..... *H01R 13/6272* (2013.01); *H01R 4/184* (2013.01); *H01R 13/422* (2013.01); *H01R 13/631* (2013.01)

(58) Field of Classification Search
USPC ..... 439/353, 680, 660
See application file for complete search history.

(56) References Cited

U.S. PATENT DOCUMENTS 3,742,424 A * 6/1973 Startin ..... H01R 13/44 439/678
5,425,650 A * 6/1995 Maeda ..... H01R 13/631 439/374
(Continued)

FOREIGN PATENT DOCUMENTS

EP 1049213 A1 11/2000
JP 2002056919 A 2/2002
(Continued)

OTHER PUBLICATIONS

Extended European Search Report (EESR) dated Mar. 3, 2017 issued in counterpart European Application No. 16200351.1.

*Primary Examiner* — Neil Abrams
(74) *Attorney, Agent, or Firm* — Holtz, Holtz & Volek PC

(57) ABSTRACT

A connector is mateable with a mating connector along a front-rear direction. The mating connector has a mating lock portion. The connector comprises a housing and a contact. The housing has an upper wall and a lower wall. The housing forms a receiving portion. The receiving portion receives the mating connector when the connector and the mating connector are mated with each other. The contact is held by the housing. The contact protrudes in the receiving portion. The receiving portion is positioned between the upper wall and the lower wall in an up-down direction perpendicular to the front-rear direction. An inner surface of the upper wall is provided with a lock portion and a protrusion portion. When the connector and the mating connector are mated with each other, the lock portion locks the mating lock portion to lock a mating of the connector with the mating connector. The protrusion portion protrudes downward in the up-down direction.

8 Claims, 11 Drawing Sheets

(51) Int. Cl.

| | |
|---|---|
| ***H01R 13/422*** | (2006.01) |
| ***H01R 13/631*** | (2006.01) |
| ***H01R 4/18*** | (2006.01) |

(56) References Cited

U.S. PATENT DOCUMENTS

| | | | | |
|---|---|---|---|---|
| 5,989,040 | A * | 11/1999 | Nishimatsu | H01R 12/725 439/680 |
| 6,790,067 | B2 * | 9/2004 | Douty | H01R 23/27 439/284 |
| 6,830,472 | B1 * | 12/2004 | Wu | H01R 13/6275 439/352 |
| 6,997,748 | B1 * | 2/2006 | Su | H01R 13/65802 439/607.55 |
| 7,057,111 | B2 * | 6/2006 | Fung | H01R 13/5224 174/74 R |
| 7,083,459 | B1 * | 8/2006 | Wu | H01R 13/6275 439/354 |
| 7,094,089 | B2 * | 8/2006 | Andre | H01R 12/7088 439/218 |
| 7,112,087 | B2 * | 9/2006 | Tago | H01R 43/24 439/495 |
| 7,824,210 | B2 * | 11/2010 | Oka | H01R 13/44 439/372 |
| 8,535,103 | B2 * | 9/2013 | Lim | H01R 13/26 439/660 |
| 8,545,275 | B2 * | 10/2013 | Wang | H01R 13/44 439/680 |
| 9,004,954 | B2 * | 4/2015 | Baldwin | H01R 13/46 439/680 |
| 9,028,269 | B2 * | 5/2015 | Hsu | H01R 13/518 439/357 |
| 9,300,090 | B2 * | 3/2016 | Xu | H01R 13/11 |
| 9,537,261 | B2 * | 1/2017 | Chen | H01R 13/642 |
| 2001/0046814 | A1 | 11/2001 | Tsuji et al. | |
| 2002/0132510 | A1 | 9/2002 | Tsuji et al. | |

FOREIGN PATENT DOCUMENTS

| | | | |
|---|---|---|---|
| JP | 2012028060 | A | 2/2012 |
| JP | 2014179290 | A | 9/2014 |
| WO | 2009065051 | A1 | 5/2009 |

* cited by examiner

CONNECTOR AND CONNECTOR ASSEMBLY WITH TOUCH ROTECTION FEATURE

CROSS REFERENCE TO RELATED APPLICATIONS

This application is based on and claims priority under 35 U.S.C. §119 to Japanese Patent Application No. JP2016-000359 filed Jan. 5, 2016, the contents of which are incorporated herein in their entirety by reference.

BACKGROUND OF THE INVENTION

This invention relates to a connector which is mateable with a mating connector, and to a connector assembly.

Referring to FIGS. 21 and 22, JP-A 2002-056919 (Patent Document 1) discloses a connector 900 which is mateable with a receptacle 950. The connector 900 of Patent Document 1 comprises a housing 910 and a male terminal 920 which is held by the housing 910. The housing 910 has an upper wall 932 and forms a receiving portion 915. An inner surface 935 of the upper wall 932 is provided with a regulating protrusion 925 which protrudes downward. An outer surface 940 of the upper wall 932 is provided with a lock portion 930 which protrudes upward. The receptacle 950 of Patent Document 1 comprises a female terminal 960 and a receptacle housing 965. The receptacle housing 965 has a female terminal accommodation portion 980 and a lock arm 970. The female terminal accommodation portion 980 accommodates the female terminal 960. The lock arm 970 has a locking lug 975 at an end thereof. The locking lug 975 protrudes downward. When the connector 900 is mated with the receptacle 950, the locking lug 975 of the lock arm 970 of the receptacle 950 is engaged with the lock portion 930 of the connector 900 while the female terminal accommodation portion 980 of the receptacle 950 is received in the receiving portion 915 of the connector 900. Referring to FIG. 22, in a case where a test finger 990, which imitates a user's finger, is inserted in the receiving portion 915 of the connector 900, the regulating protrusion 925 of the connector 900 abuts against the test finger 990. Accordingly, an end of the test finger 990 is prevented from being brought into contact with an end of the male terminal 920.

SUMMARY OF THE INVENTION

It is an object of the present invention to provide a connector which has a function preventing electrical shock and which has a reduced size.

One aspect (first aspect) of the present invention provides a connector mateable with a mating connector along a front-rear direction. The mating connector has a mating lock portion. The connector comprises a housing and a contact. The housing has an upper wall and a lower wall. The housing forms a receiving portion. The receiving portion receives the mating connector when the connector and the mating connector are mated with each other. The contact is held by the housing. The contact protrudes in the receiving portion. The receiving portion is positioned between the upper wall and the lower wall in an up-down direction perpendicular to the front-rear direction. An inner surface of the upper wall is provided with a lock portion and a protrusion portion. When the connector and the mating connector are mated with each other, the lock portion locks the mating lock portion to lock a mating of the connector with the mating connector. The protrusion portion protrudes downward in the up-down direction.

Another aspect (second aspect) of the present invention provides a connector assembly comprising the connector of the first aspect and the mating connector.

The protrusion portion protrudes downward in the up-down direction from the inner surface of the upper wall, and a space exists around the protrusion portion. The lock portion is provided on the inner surface of the upper wall by utilizing the space. Accordingly, the connector of the present invention has a function preventing electrical shock and has a reduced size as compared with the connector of Patent Document 1 having the lock portion which protrudes upward from the outer surface of the upper wall of the housing.

An appreciation of the objectives of the present invention and a more complete understanding of its structure may be had by studying the following description of the preferred embodiment and by referring to the accompanying drawings.

Figure 1:
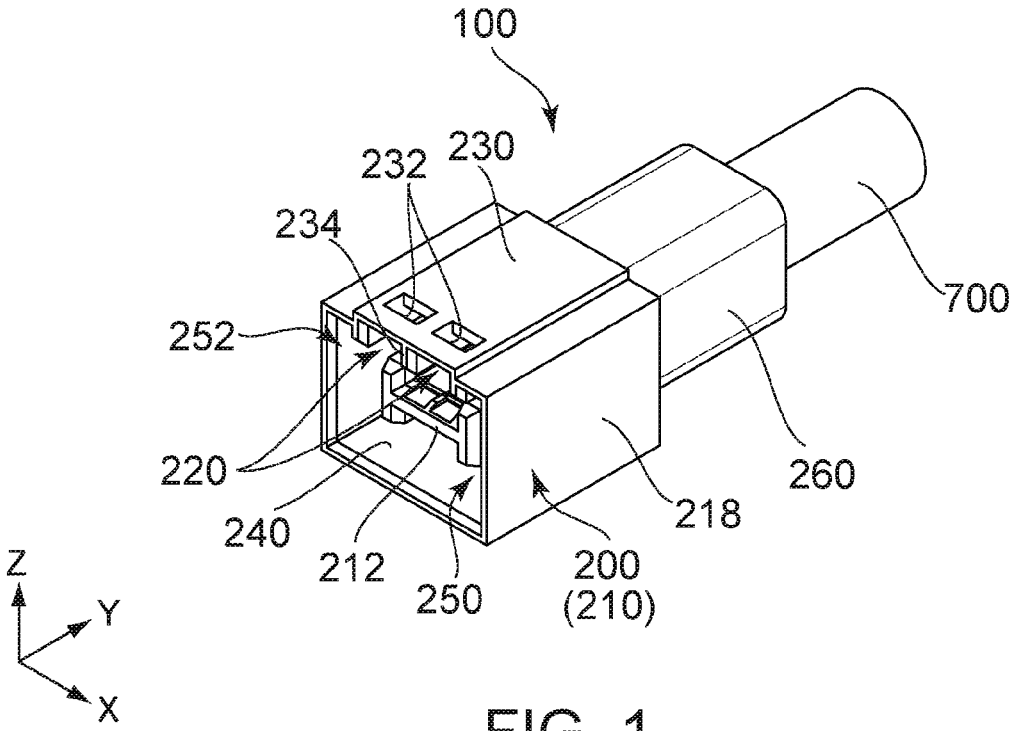
FIG. 1 is an upper perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 9:
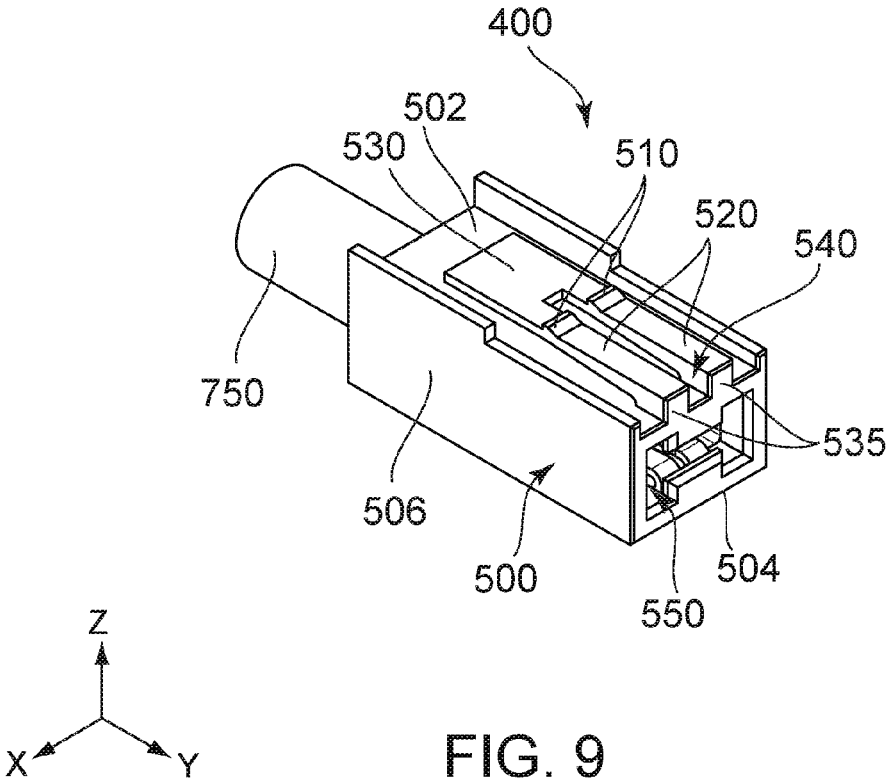
FIG. 9 is an upper perspective view showing a mating connector according to an embodiment of the present invention.
Figure 10:
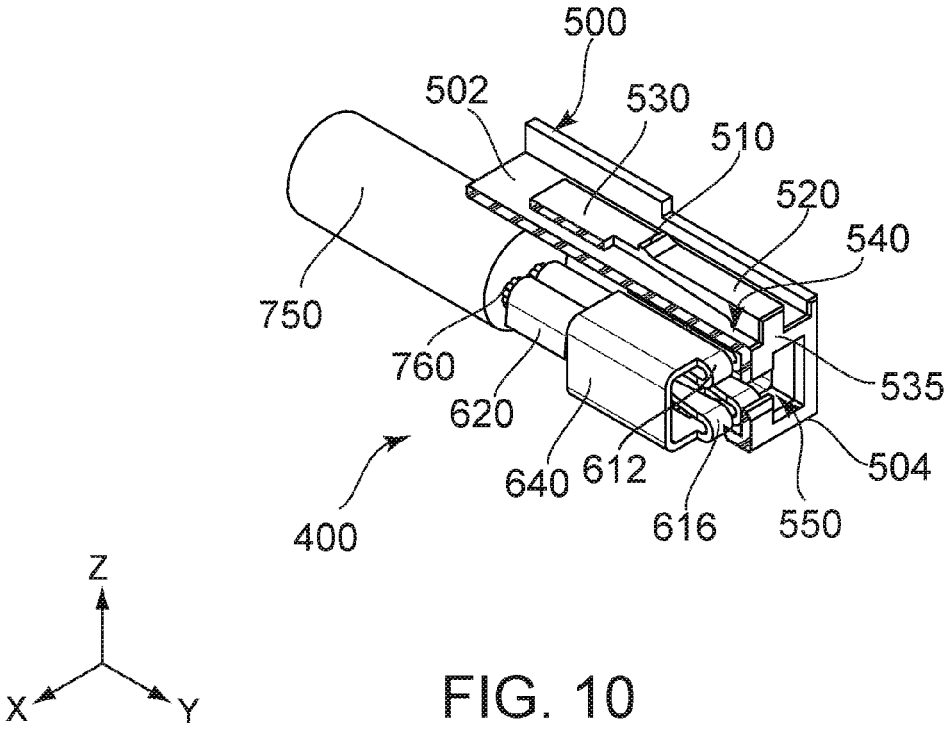
FIG. 10 is an upper perspective view showing the mating connector of FIG. 9 with a partial cross-section of a mating housing thereof.
Figure 11:
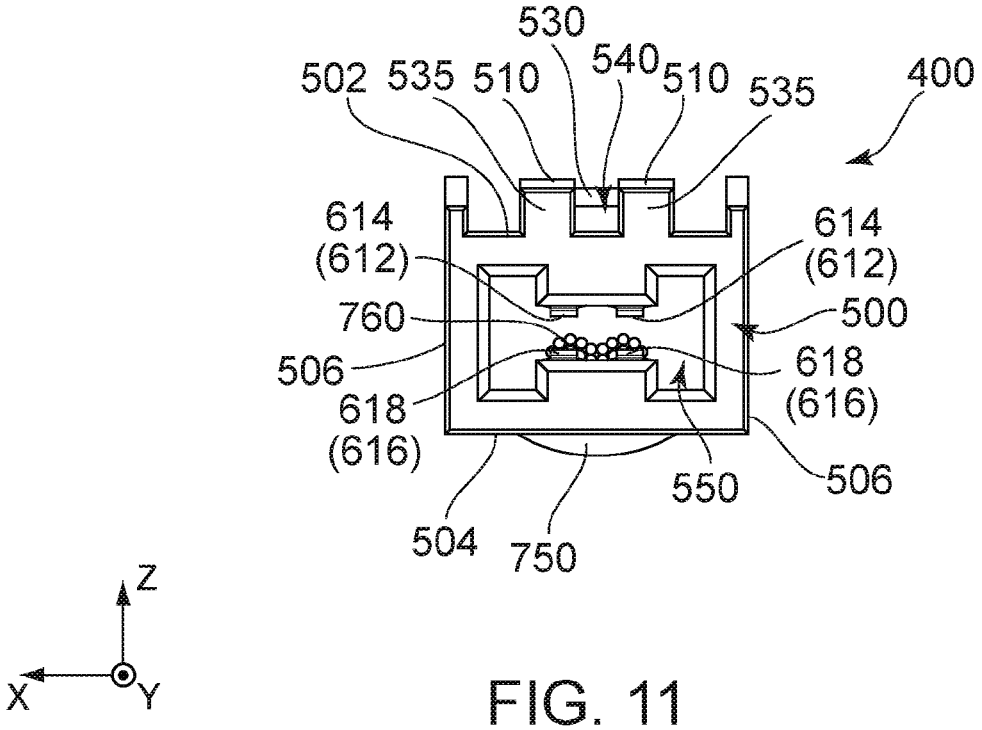
FIG. 11 is a front view showing the mating connector of FIG. 9.
Figure 14:
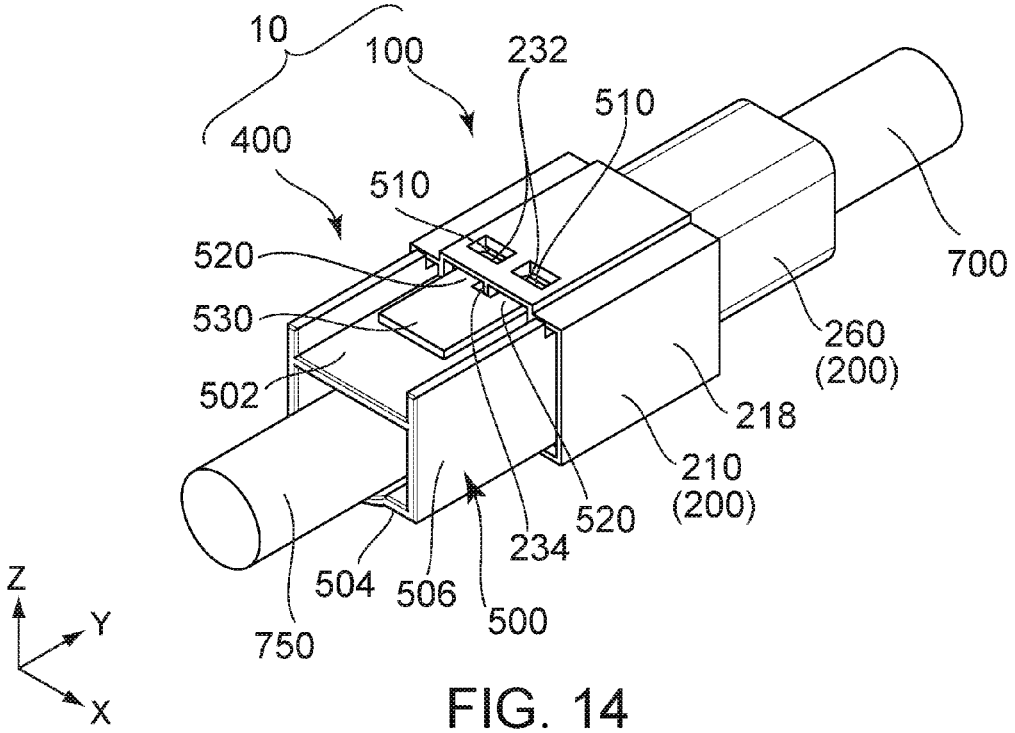
FIG. 14 is an upper perspective view showing a connector assembly which consists of the connector of FIG. 1 and the mating connector of FIG. 9, wherein the connector and the mating connector are in a mated state.
Figure 15:
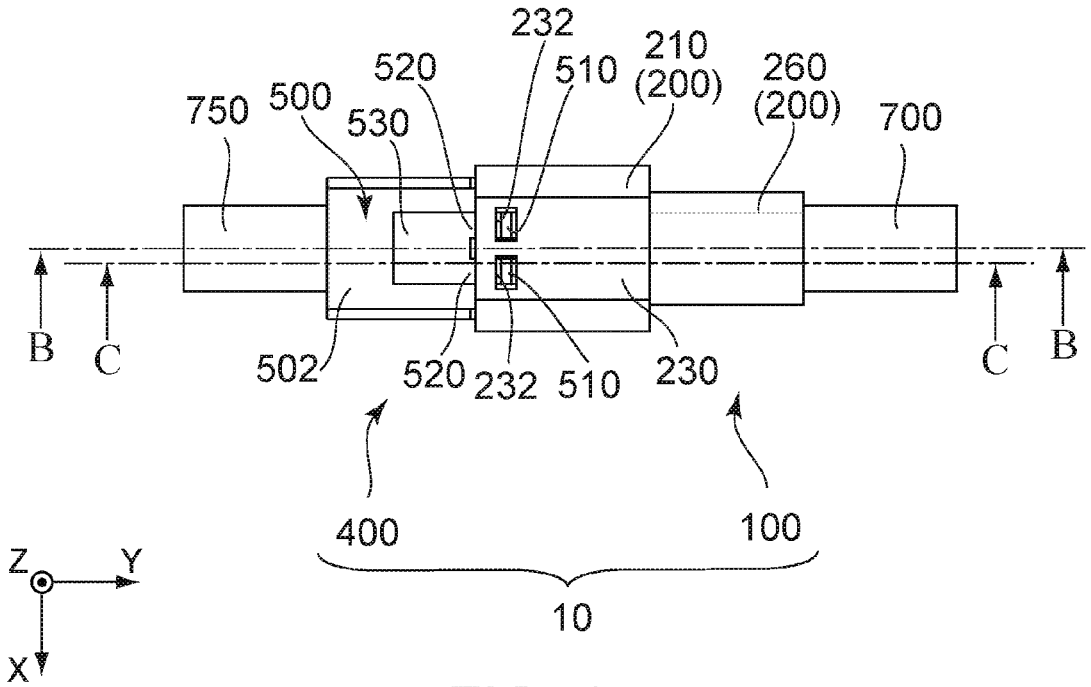
FIG. 15 is a top view showing the connector assembly of FIG. 14.
Figure 16:
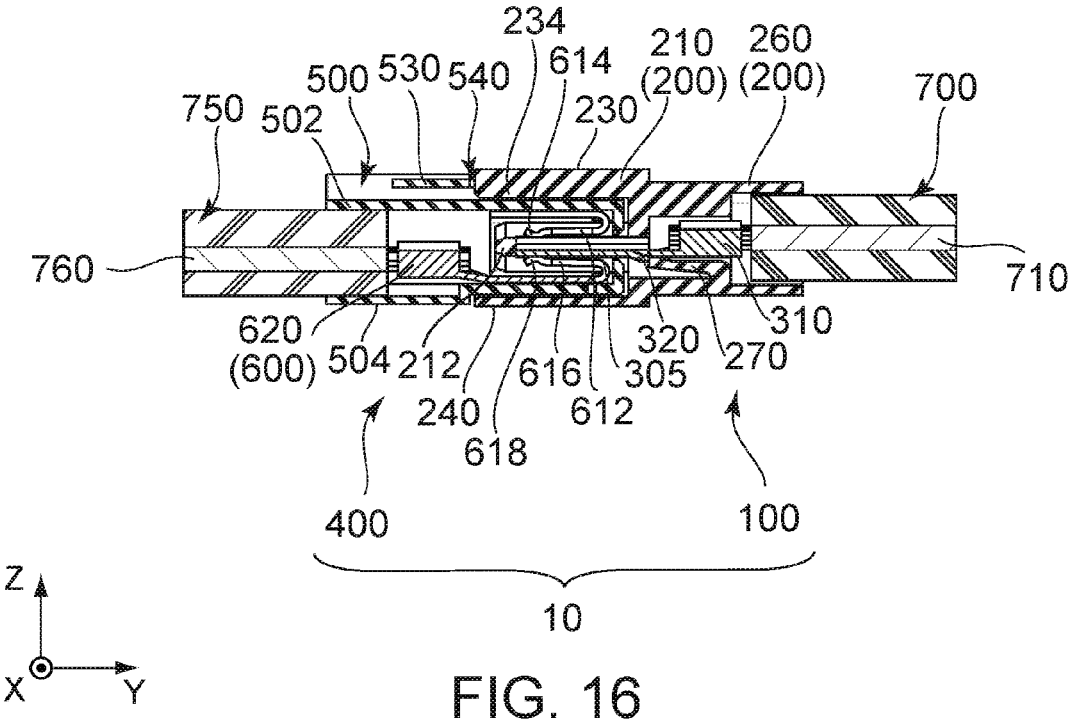
FIG. 16 is a cross-sectional view showing the connector assembly of FIG. 15, taken along line B-B, wherein core wires and core wire holders are illustrated in a simplified manner.
Figure 17:
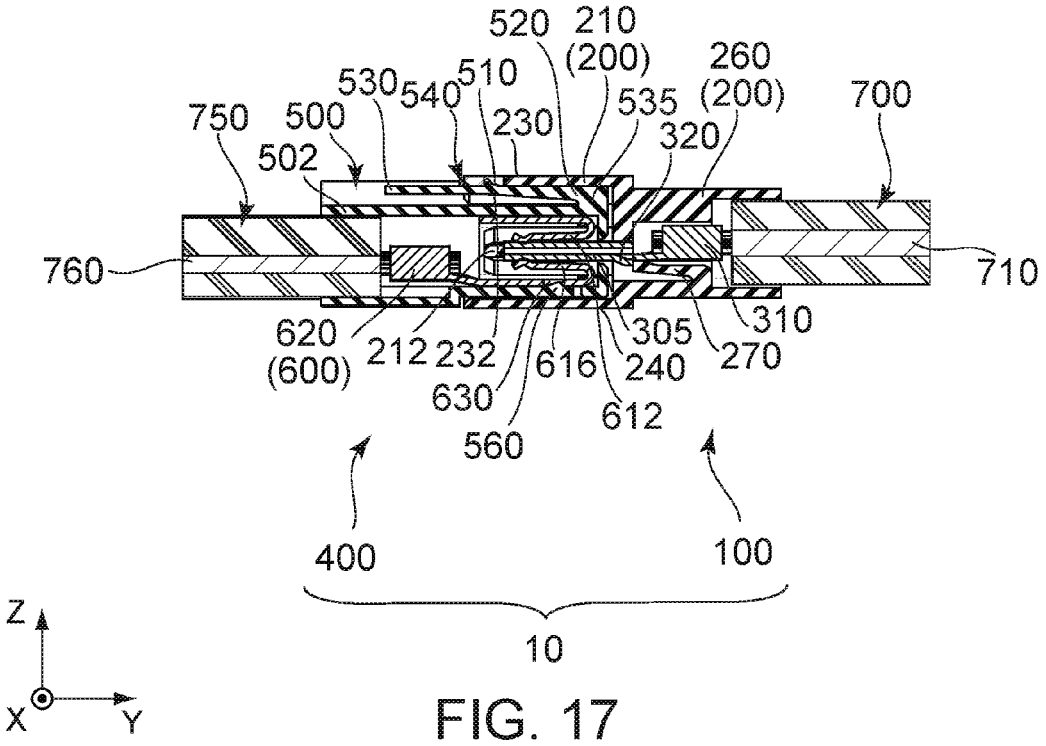
FIG. 17 is a cross-sectional view showing the connector assembly of FIG. 15, taken along line C-C, wherein the core wires and the core wire holders are illustrated in a simplified manner.
Figure 18:
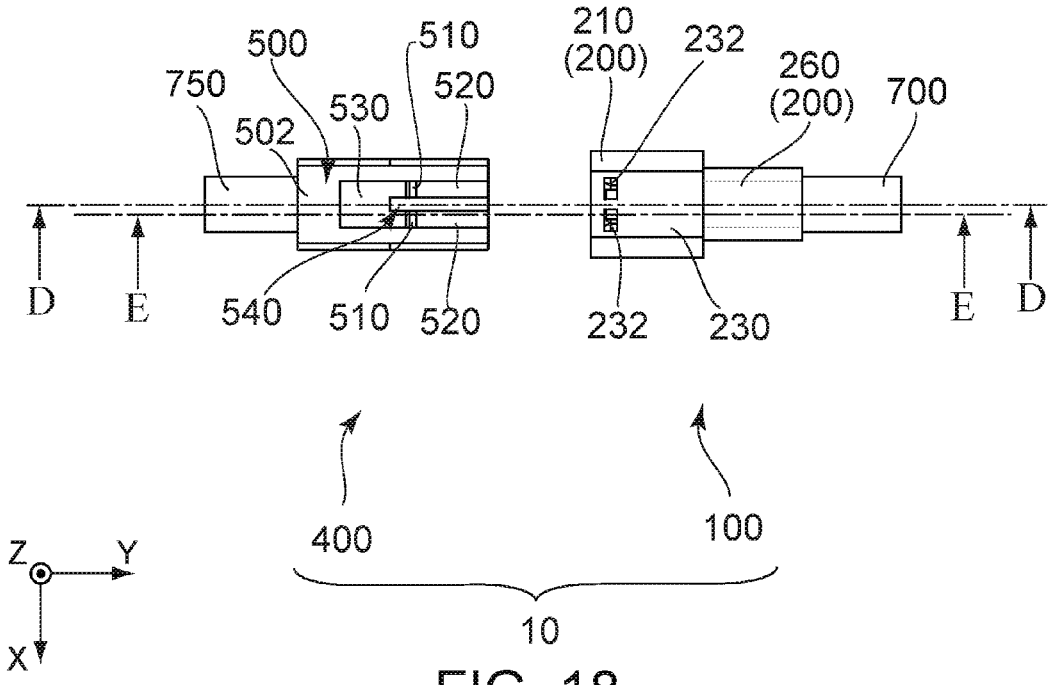
FIG. 18 is a top view showing the connector assembly of FIG. 14, wherein the connector and the mating connector are not mated with each other.
Figure 19:
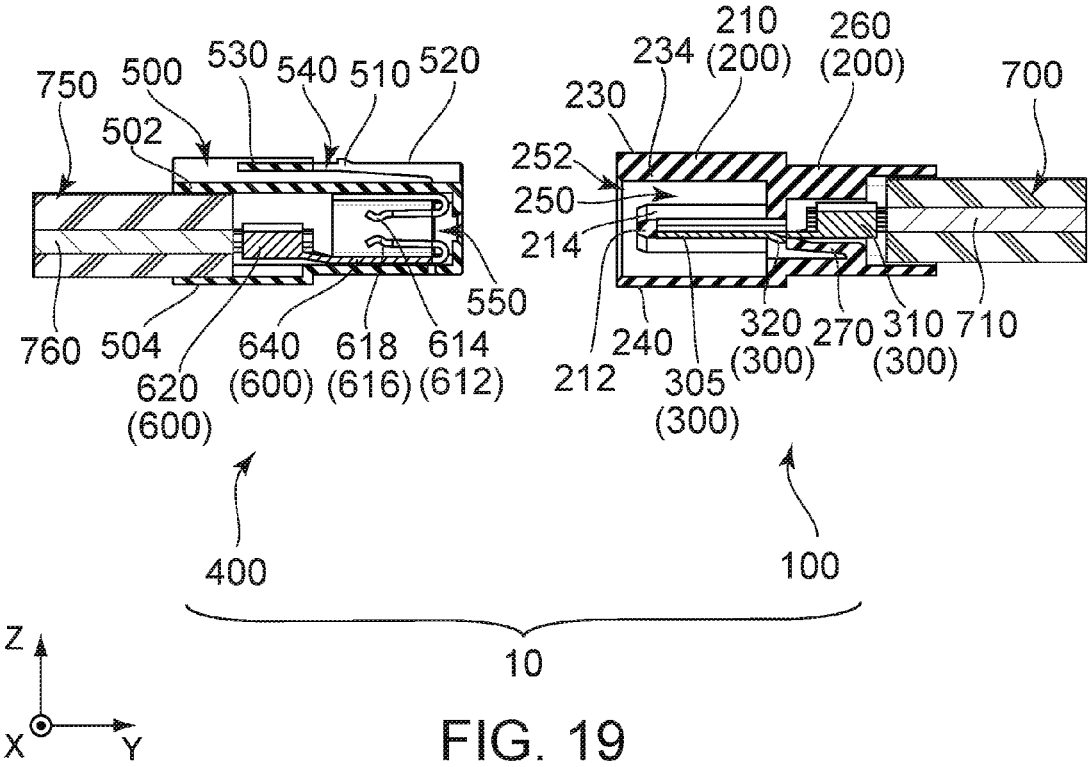
FIG. 19 is a cross-sectional view showing the connector assembly of FIG. 18, taken along line D-D. The core wires and the core wire holders are illustrated in a simplified manner.
Figure 20:
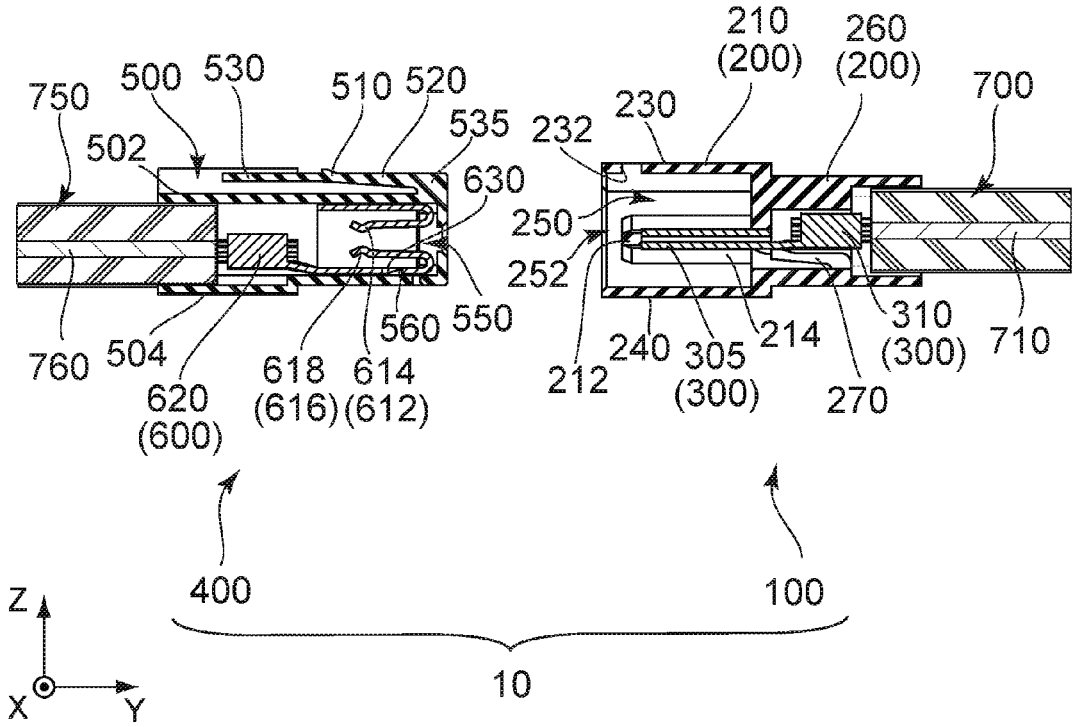
FIG. 20 is a cross-sectional view showing the connector assembly of FIG. 18, taken along line E-E, wherein the core wires and the core wire holders are illustrated in a simplified manner.
Figure 21:
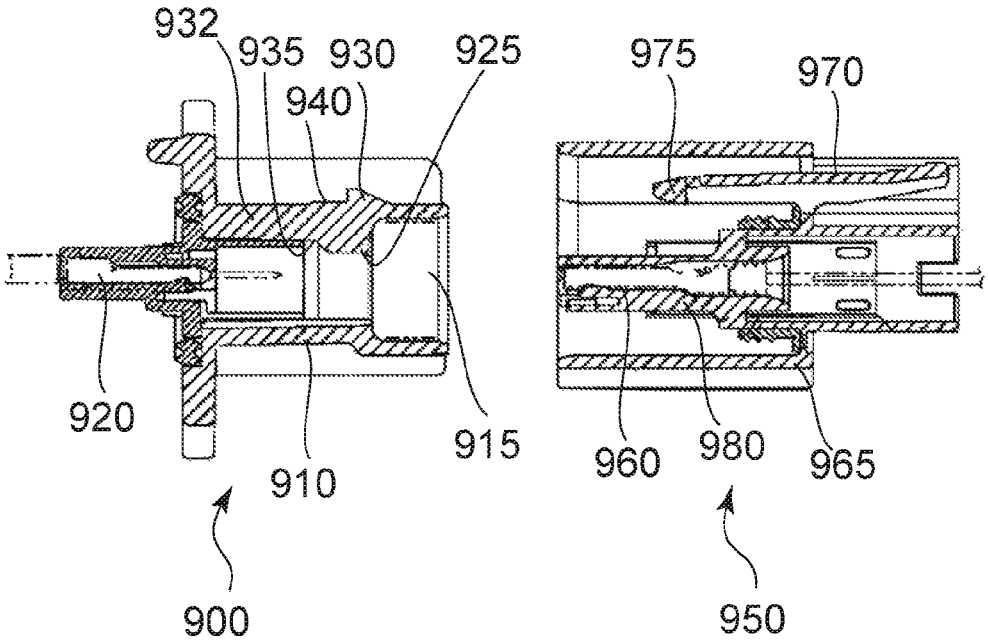
FIG. 21 PRIOR ART
FIG. 21 is a cross-sectional view showing a connector assembly of Patent Document 1.
Figure 22:
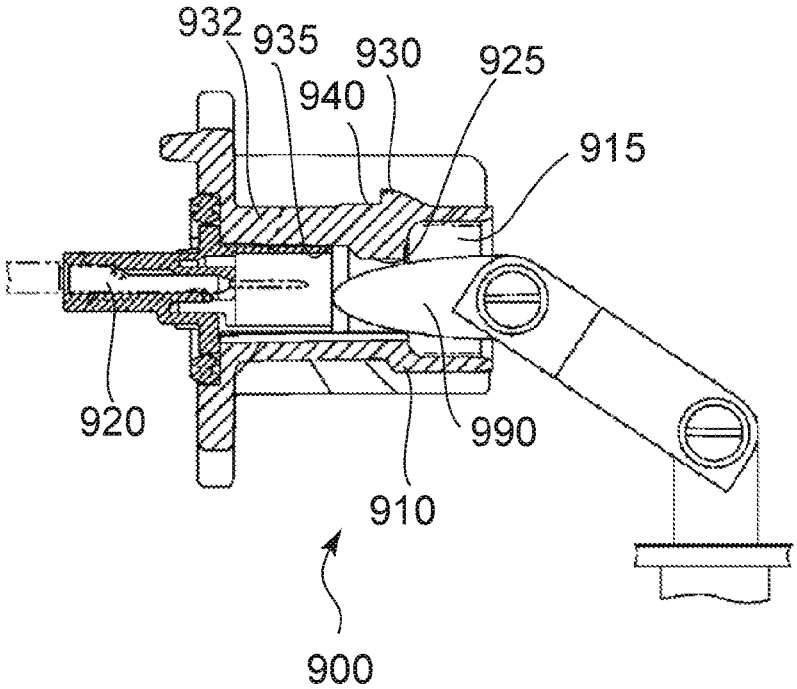
FIG. 22 PRIOR ART
FIG. 22 is a cross-sectional view showing a state where a test finger is inserted in a connector which is included in the connector assembly of FIG. 21.

Referring to FIGS. 1, 9 and 14, a connector assembly 10 according to an embodiment of the present invention comprises a connector 100 and a mating connector 400.

As understood from FIGS. 1, 9 and 14, the connector 100 according to the embodiment of the present invention is connectable with a cable 700 and is mateable with the mating connector 400 along a front-rear direction. Explanation will be made later about specific connection of the connector 100 and the mating connector 400. In the present embodiment, the front-rear direction is a Y-direction.

As shown in FIGS. 1 to 5, the connector 100 of the present embodiment comprises a housing 200 and a contact 300. The housing 200 is made of insulator. The contact 300 is made of metal and is held by the housing 200.

As shown in FIGS. 1 to 5, the housing 200 has a fitting portion 210 and a cable holder 260. The fitting portion 210 is configured to be mated with the mating connector 400. The cable holder 260 is positioned rearward of the fitting portion 210 in the front-rear direction. Rearward is a positive Y-direction, and forward is a negative Y-direction.

As shown in FIGS. 1 to 5, the fitting portion 210 has an upper wall 230, a lower wall 240, two side walls 218 and a rear wall 216. The fitting portion 210 forms a receiving portion 250. The upper wall 230 is positioned above the lower wall 240 in an up-down direction. In the present embodiment, the up-down direction is a Z-direction. Upward is a positive Z-direction, and downward is a negative Z-direction. The two side walls 218 face each other in a lateral direction perpendicular to both the front-rear direction and the up-down direction. In the present embodiment, the lateral direction is an X-direction. In the front-rear direction, the rear wall 216 is positioned at a rear end of the fitting portion 210 and is positioned at a front end of the cable holder 260. The receiving portion 250 is positioned between the upper wall 230 and the lower wall 240 in the up-down direction. The receiving portion 250 is positioned between the two side walls 218 in the lateral direction. The receiving portion 250 has an opening 252 which is opened at a front end thereof.

As understood from FIGS. 1 to 5 and 20, an inner surface of the upper wall 230 is provided with two lock portions 232 and a protrusion portion 234. Each of the lock portions 232 of the present embodiment is a front surface, or a negative Y-side surface, of inside surfaces of a hole which pierces the upper wall 230 in the up-down direction. The protrusion portion 234 protrudes downward in the up-down direction and is positioned between the two lock portions 232 in the lateral direction. The protrusion portion 234 may, however, not be aligned with each of the lock portions 232 in the front-rear direction.

As understood from FIGS. 1 to 5, the fitting portion 210 is formed with a holding portion 214. The holding portion 214 extends forward from the rear wall 216 in the receiving portion 250 and holds the contact 300. From a perspective plan view of the connector 100 along the up-down direction, the holding portion 214 has an angular C-like shape. The holding portion 214 has an H-like cross-section in a plane perpendicular to the front-rear direction. The holding portion 214 has an insulating portion 212 which is positioned at a front end of the holding portion 214 in the front-rear direction. In other words, the insulating portion 212 is a part of the holding portion 214. Accordingly, the number of components of the connector 100 can be reduced and the contact 300 can be rigidly held to the housing 200.

Figure 2:
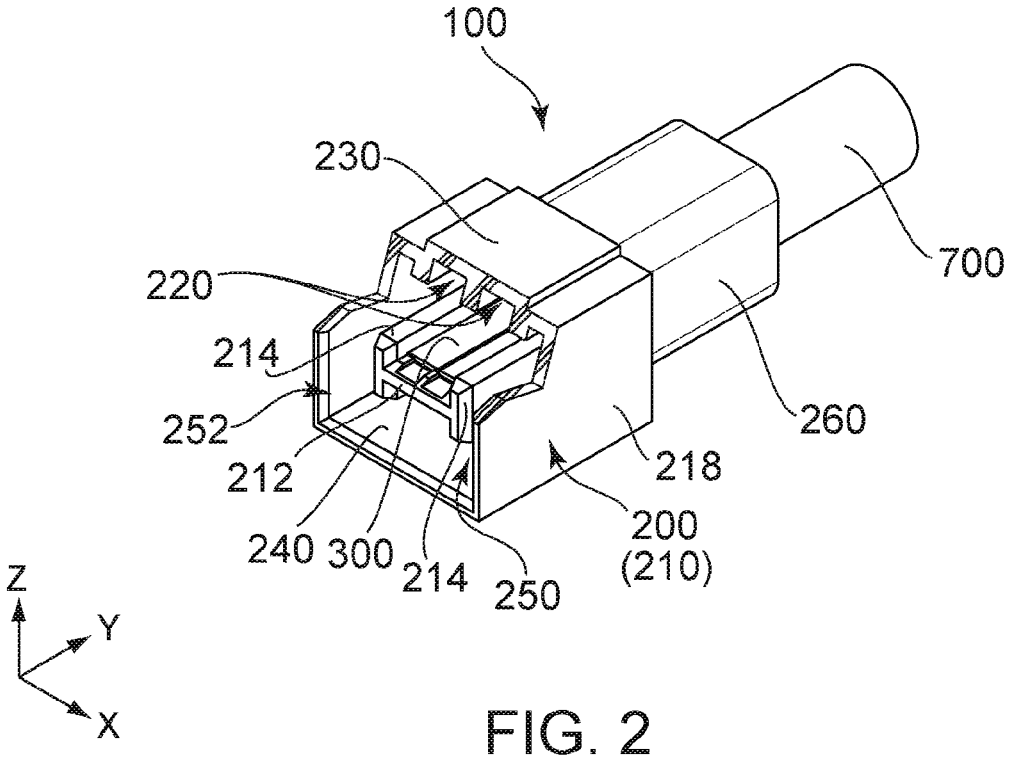
FIG. 2 is an upper perspective view showing the connector of FIG. 1 with a partial cross-section of a housing thereof.
Figure 3:
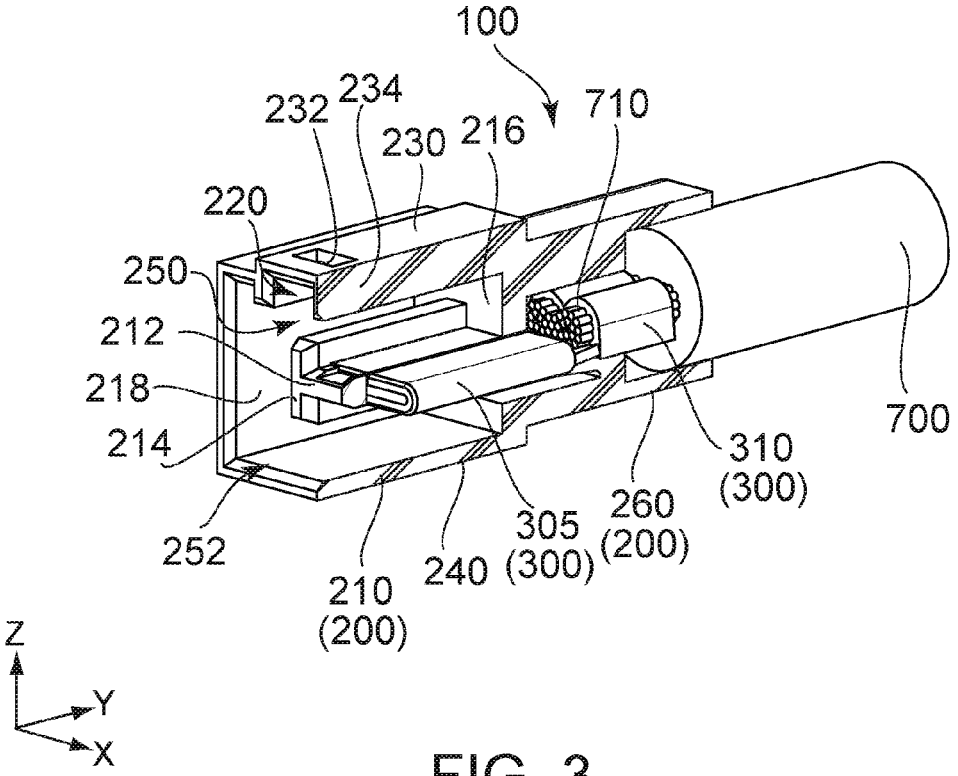
FIG. 3 is another upper perspective view showing the connector of FIG. 1 with a partial cross-section of the housing thereof.
Figure 4:
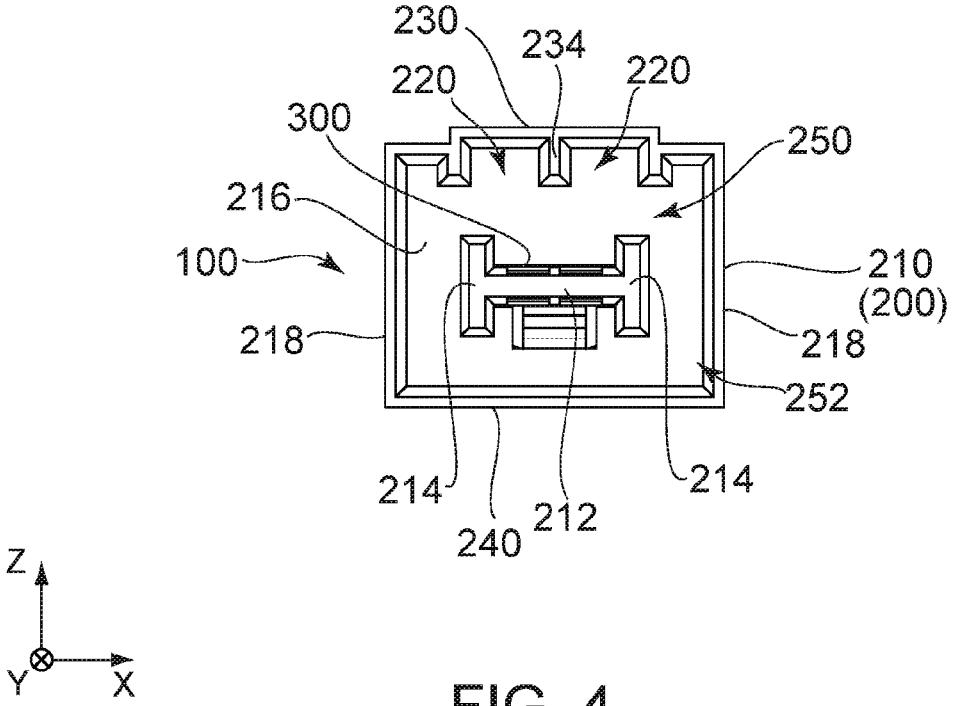
FIG. 4 is a front view showing the connector of FIG. 1.
Figure 5:
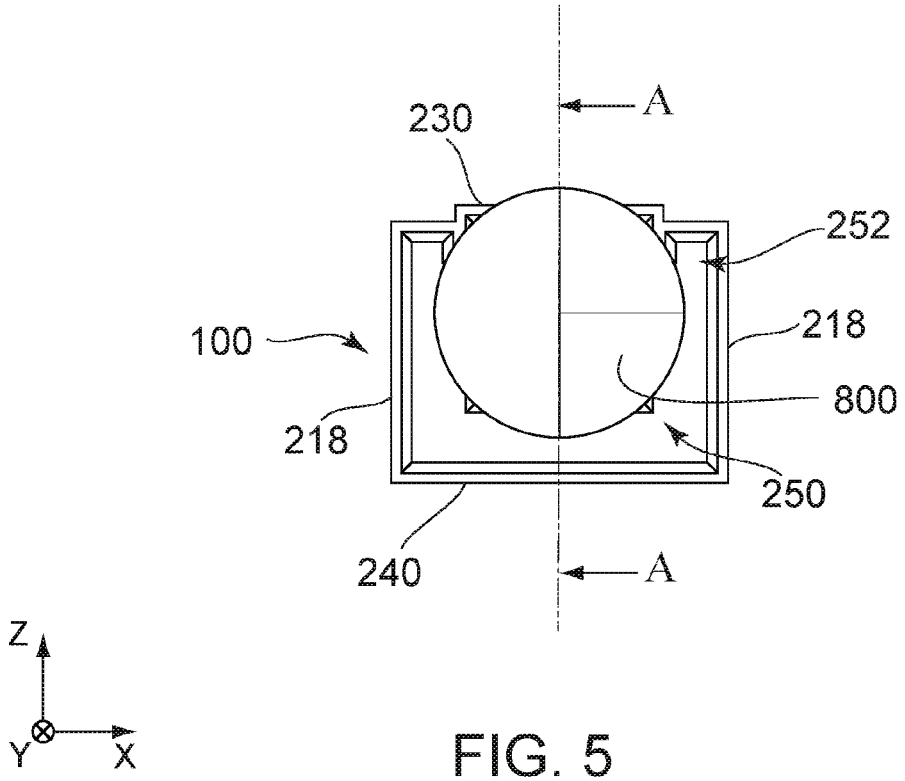
FIG. 5 is a front view showing a state where a test finger is inserted in the connector of FIG. 4

As shown in FIGS. 1 to 3, the fitting portion 210 further has two spring accommodation portions 220. Each of the spring accommodation portions 220 is positioned at an upper part of the receiving portion 250 and is positioned in the vicinity of the inner surface of the upper wall 230. Each of the spring accommodation portions 220 and the protrusion portion 234 are arranged in the lateral direction. In other words, the protrusion portion 234 is positioned between the two spring accommodation portions 220 in the lateral direction.

As understood from FIGS. 1 to 6, the cable holder 260 holds a front end of the cable 700. The cable holder 260 has a contact fixing portion 270 by which the contact 300 is fixed to the housing 200. The contact fixing portion 270 extends forward and upward. A front end of the contact fixing portion 270 is a free end and is resiliently deformable downward.

Figure 7:
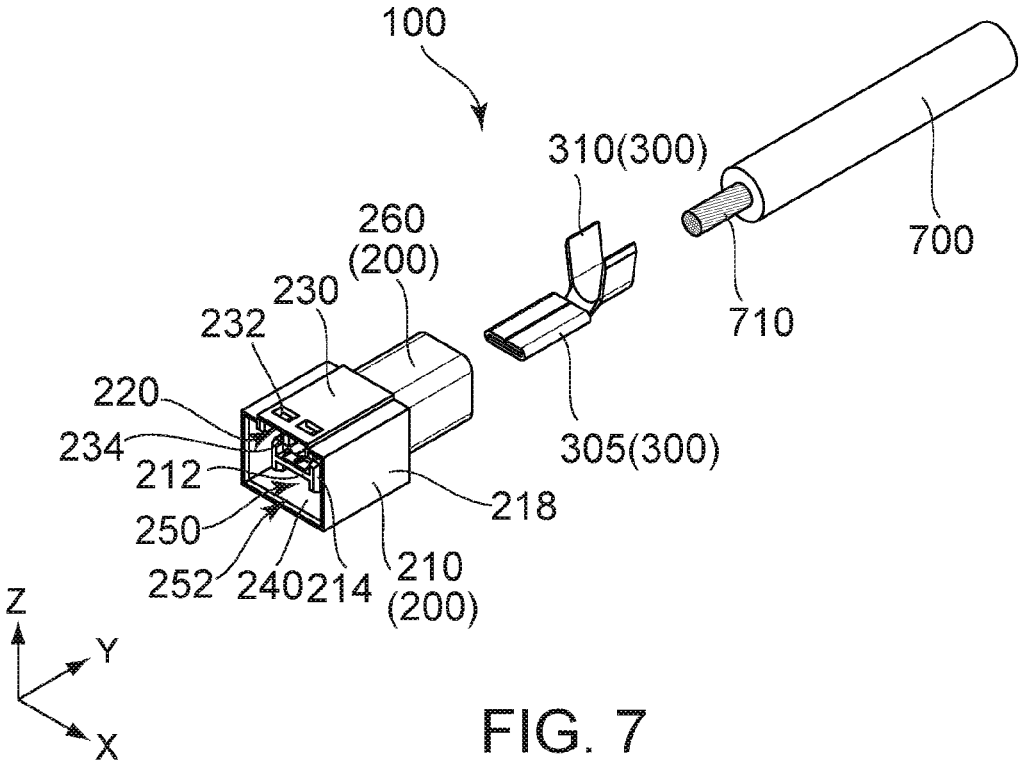
FIG. 7 is an exploded, perspective view showing the connector of FIG. 1.
Figure 8:
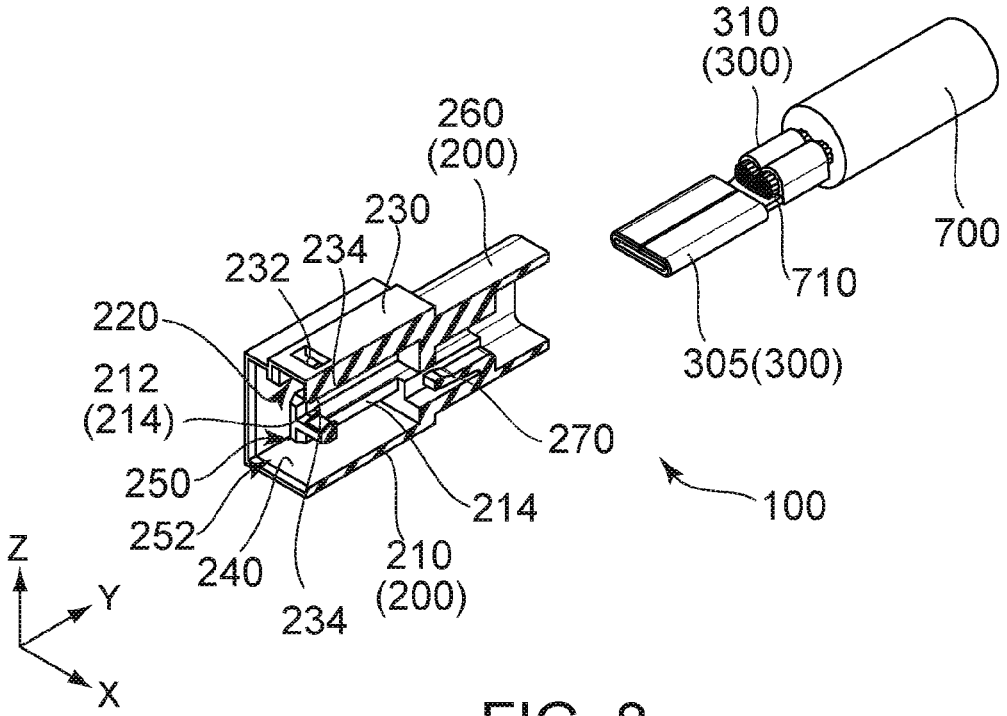
FIG. 8 is an exploded, perspective view showing the connector of FIG. 3, wherein a contact is attached to a cable.

As shown in FIGS. 3, 7 and 8, the contact 300 of the present embodiment has a flat shape. Accordingly, in a case where the contact 300 needs to have an increased cross-sectional area in a plane perpendicular to the front-rear direction in order to allow large current flow, the contact 300 can have the increased cross-sectional area by increasing a size of a contact portion 305 in the lateral direction without increasing a size of the contact 300 in the up-down direction, so that the contact 300 having the increased cross-sectional area can allow large current flow. Thus, the connector 100 can be prevented from being increased in size in the up-down direction.

As shown in FIGS. 1 to 3 and 6, the contact 300 of the present embodiment protrudes in the receiving portion 250 of the fitting portion 210. A front end of the contact 300 is brought into abutment with a rear end of the insulating portion 212.

As understood from FIGS. 3, 4 and 6 to 8, the contact 300 of the present embodiment has the contact portion 305, a core wire holder 310 and a fixed portion 320. The contact portion 305 is positioned in the receiving portion 250 of the fitting portion 210. The core wire holder 310 is configured to hold a core wire 710 of the cable 700 and is positioned in the cable holder 260. The core wire holder 310 has a U-shaped cross-section in a plane perpendicular to the front-rear direction under a state where the core wire 710 of the cable 700 is not attached to the core wire holder 310. The fixed portion 320 is positioned between the contact portion 305 and the core wire holder 310 in the front-rear direction. The fixed portion 320 has a shape which slopes downward and rearward.

Figure 6:
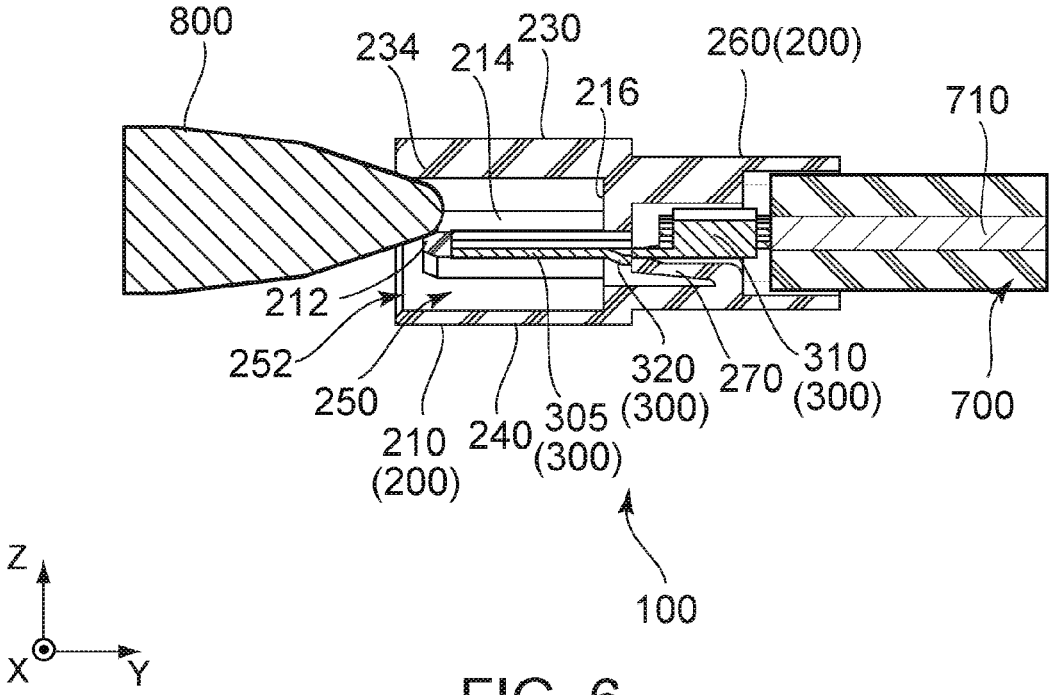
FIG. 6 is a cross-sectional view showing the connector of FIG. 5, taken along line A-A, wherein a core wire and a core wire holder are illustrated in a simplified manner.

Referring to FIGS. 6 to 8, the connector 100 is fabricated by attaching the cable 700 to the contact 300, followed by attaching the contact 300 to the housing 200. Specifically, the core wire 710 of the cable 700 is inserted into the core wire holder 310 which is opened to have the U-like shape, and the core wire holder 310 is then crimped around the core wire 710, so that the core wire holder 310 is fixed to the core wire 710. After that, when the contact 300, to which the core wire 710 of the cable 700 is fixed as described above, is inserted toward the opening 252 from a rear end of the housing 200, the fixed portion 320 of the contact portion 305 of the contact 300 is brought into contact with the contact fixing portion 270 so that the vicinity of the front end of the contact fixing portion 270, or the vicinity of the free end thereof, is pressed to be moved downward. As the contact 300 continues to be further inserted toward the opening 252, a rear end of the fixed portion 320 rides over the free end of the contact fixing portion 270 while the front end of the contact portion 305 of the contact 300 abuts against the rear end of the insulating portion 212. Meanwhile, the contact fixing portion 270 restores to its original shape by its resilience, and the rear end of the fixed portion 320 and the free end of the contact fixing portion 270 abut against each other in the front-rear direction. Accordingly, the contact 300 is fixed in the housing 200.

Referring to FIG. 6, in a case where a test finger 800, which imitates a user's finger, is inserted from the opening 252 of the receiving portion 250 of the connector 100 toward the rear wall 216 thereof, the test finger 800 abuts against the protrusion portion 234 before being brought into contact with the contact portion 305 of the contact 300. In other words, since the connector 100 of the present embodiment has the protrusion portion 234, a user's finger is prevented from being brought into contact with the contact 300 when the user's finger is inadvertently inserted into the receiving portion 250.

In addition, referring to FIG. 6, the insulating portion 212 of the holding portion 214 is positioned forward beyond the contact portion 305 of the contact 300. Accordingly, in a case where the test finger 800 is inserted into the receiving portion 250, the test finger 800 abuts against the insulating portion 212 before being brought into contact with the contact portion 305 of the contact 300. In other words, since the connector 100 of the present embodiment has the insulating portion 212, a user's a finger is further prevented from being brought into contact with the contact 300 when the user's finger is inadvertently inserted into the receiving portion 250.

As understood from FIGS. 9 to 13, the mating connector 400 according to the embodiment of the present invention is connectable with a cable 750 and is mateable with the connector 100 along the front-rear direction. Explanation will be made later about specific connection of the connector 100 and the mating connector 400.

As shown in FIGS. 9 to 13, the mating connector 400 of the present embodiment comprises a mating housing 500 and a mating contact 600.

As shown in FIGS. 9 to 13, the mating housing 500 has an upper wall 502, a lower wall 504 and two side walls 506. Specifically, the upper wall 502 and the lower wall 504 face each other in the up-down direction, and the two side walls 506 face each other in the lateral direction. The upper wall 502 is positioned above the lower wall 504 in the up-down direction. The upper wall 502, the lower wall 504 and the two side walls 506 form a connector receiving portion 550. The connector receiving portion 550 receives the contact portion 305 and the holding portion 214 of the connector 100 when the connector 100 and the mating connector 400 are mated with each other.

As shown in FIGS. 9 to 13, 19 and 20, the mating housing 500 further has two mating lock portions 510, two spring portions 520, a coupling portion 530 and two connecting portions 535. Specifically, the spring portions 520 support the mating lock portions 510, respectively, and the coupling portion 530 couples the spring portions 520 with each other.

As shown in FIGS. 9 to 13, 19 and 20, each of the mating lock portions 510 of the present embodiment is a protrusion which protrudes upward. More specifically, each of the mating lock portions 510 has a slope which slopes downward as it extends in the positive Y-direction, and an end of each of the mating lock portions 510 in the negative Y-direction is a plane perpendicular to the front-rear direction. Each of the mating lock portions 510 is positioned on an upper surface of the corresponding spring portion 520 and is positioned in the vicinity of an end of the corresponding spring portion 520 in the negative Y-direction. The two spring portions 520 are positioned away from each other in the lateral direction. The coupling portion 530 is positioned beyond the spring portions 520 in the negative Y-direction and is positioned away from an outer surface of the upper wall 502 in the up-down direction. The connecting portions 535 are positioned at ends of the spring portions 520, respectively, in the positive Y-direction. The connecting portions 535 are positioned in the vicinity of an end of the outer surface of the upper wall 502 in the positive Y-direction. Each of the connecting portions 535 connects the corresponding spring portion 520 with the outer surface of the upper wall 502. Since each of the spring portions 520 is resiliently deformable in a state of being fixed to the corresponding connecting portion 535, each of the mating lock portions 510 is movable in the up-down direction.

As shown in FIGS. 9 to 13, 19 and 20, the mating housing 500 further has a groove 540 and two mating contact fixing members 562.

The groove 540 is a portion which receives the protrusion portion 234 of the connector 100 when the connector 100 and the mating connector 400 are mated with each other. The groove 540 is positioned between the two spring portions 520 in the lateral direction. The lower wall 504 is formed with ditches 505. The mating contact fixing members 562 are positioned inward of the ditches 505. Each of the mating contact fixing members 562 extends in the positive Y-direction. Specifically, the mating contact fixing members 562 are coupled with the lower wall 504 only at negative Y-side ends thereof. The mating contact fixing members 562 are provided with two mating contact fixing portions 560 in the vicinities of positive Y-side ends thereof, respectively. Each of the mating contact fixing portions 560 protrudes upward. The mating contact fixing portions 560 are arranged in the lateral direction. More specifically, each of the mating contact fixing portions 560 has a slope which slopes downward at it extends in the negative Y-direction, and an end of each of the mating contact fixing portions 560 in the positive Y-direction is a plane perpendicular to the front-rear direction. Each of the mating contact fixing members 562 is resiliently deformable with the negative Y-side end thereof acting as a fulcrum. Accordingly, each of the mating contact fixing portions 560 is movable in the up-down direction.

As shown in FIGS. 10 to 13, the mating contact 600 has two upper contact portions 612, two lower contact portions 616, a contact portion holder 640, a core wire holder 620 and two fixed portions 630.

As shown in FIGS. 9 to 11, 13, 19 and 20, the two upper contact portions 612 are arranged so as to face the two lower contact portions 616, respectively, in the up-down direction. Each of the upper contact portions 612 has an upper contact point 614. Each of the lower contact portions 616 has a lower contact point 618. The contact portion holder 640 holds the two upper contact portions 612 and the two lower contact portions 616. The contact portion holder 640 is positioned in the connector receiving portion 550. The core wire holder 620 holds a core wire 760 of the cable 750 and is positioned in the mating housing 500. The core wire holder 620 has a U-shaped cross-section in a plane perpendicular to the front-rear direction under a state where the core wire 760 of the cable 750 is not attached to the core wire holder 620. Each of the fixed portions 630 is a hole which pierces a lower surface of the contact portion holder 640 in the up-down direction.

Figure 12:
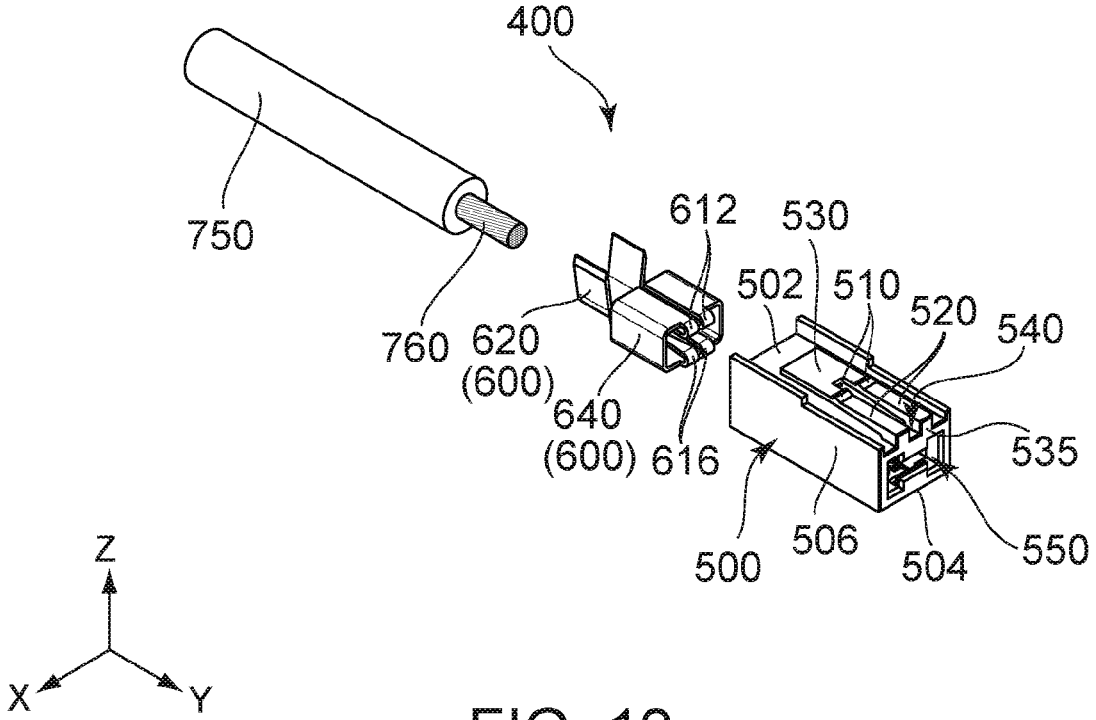
FIG. 12 is an exploded, perspective view showing the mating connector of FIG. 9.
Figure 13:
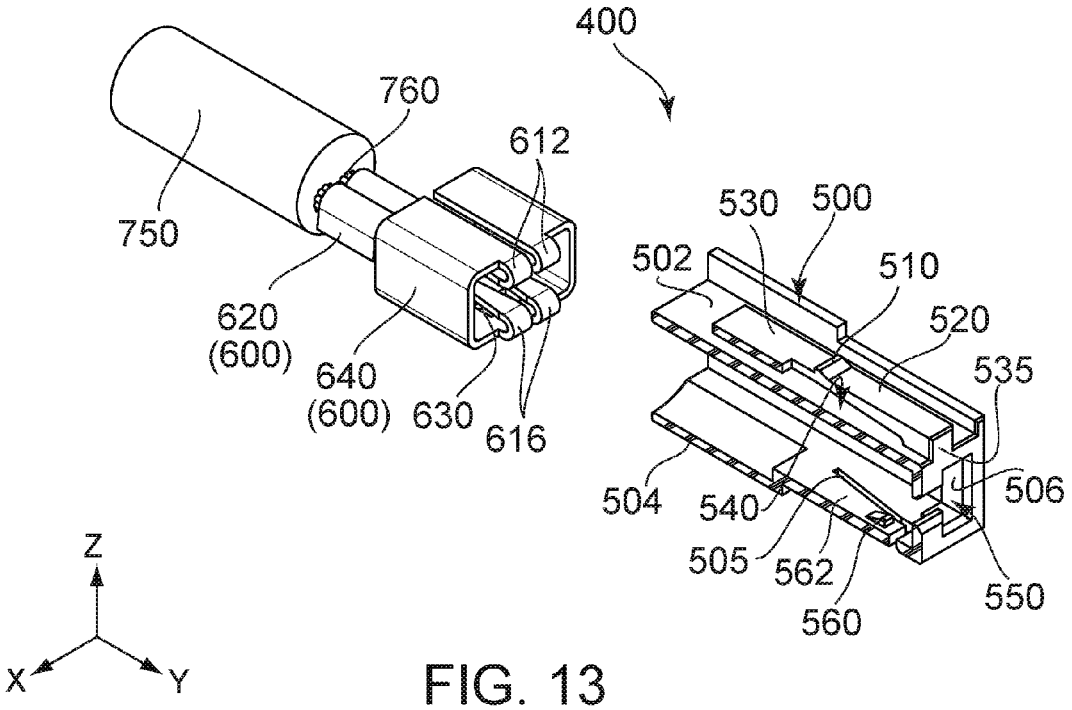
FIG. 13 is an exploded, perspective view showing the mating connector of FIG. 10, wherein a mating contact is attached to a cable.

Referring to FIGS. 12 and 13, the mating connector 400 is fabricated by attaching the cable 750 to the mating contact 600, followed by attaching the mating contact 600 to the mating housing 500. Specifically, the core wire 760 of the cable 750 is inserted into the core wire holder 620 which is opened to have the U-like shape, and the core wire holder 620 is then crimped around the core wire 760, so that the core wire holder 620 is fixed to the core wire 760. After that, when the mating contact 600, to which the core wire 760 of the cable 750 is fixed as described above, is inserted from a negative Y-side end of the mating housing 500 toward a positive Y-side end thereof, a positive Y-side end of a lower surface of the mating contact 600 is brought into contact with the mating contact fixing portions 560 so that each of the mating contact fixing portions 560 is pressed to be moved downward. As the mating contact 600 continues to be further inserted toward the positive Y-side end of the mating housing 500, positive Y-side ends of the fixed portions 630 ride over the mating contact fixing portions 560 and reach positions which are beyond the positive Y-side ends of the mating contact fixing portions 560, respectively, in the positive Y-direction. Meanwhile, each of the mating contact fixing members 562 restores to its original shape by its resilience, and the mating contact fixing portions 560 are received in the holes of the fixed portions 630, respectively. Accordingly, the mating contact 600 is fixed in the mating housing 500.

Referring to FIGS. 1, 9 and 14 to 20, when the connector 100 and the mating connector 400 are mated with each other, the lock portions 232 lock the mating lock portions 510, respectively, to lock a mating of the connector 100 with the mating connector 400. More specifically, when the connector 100 and the mating connector 400 are mated with each other, the protrusion of each of the mating lock portions 510 is received in the hole of the corresponding lock portion 232, so that the mating of the connector 100 with the mating connector 400 is locked. Even if the connector 100 receives a force which urges the connector 100 to move away from the mating connector 400 in the front-rear direction under the aforementioned state, and/or even if the mating connector 400 receives a force which urge the mating connector 400 to move away from the connector 100 in the front-rear direction under the aforementioned state, the front surface, or the negative Y-side surface, of the inside surfaces of the hole of each of the lock portions 232 abuts against the plane of the protrusion of the corresponding mating lock portion 510 which is positioned at the end thereof in the negative Y-direction. Accordingly, the mated state of the connector 100 with the mating connector 400 is maintained.

As understood from FIGS. 1, 9 and 14 to 20, the receiving portion 250 of the connector 100 receives the mating connector 400 when the connector 100 and the mating connector 400 are mated with each other. In addition, the connector receiving portion 550 of the mating connector 400 receives the contact portion 305 and the holding portion 214 of the connector 100 when the connector 100 and the mating connector 400 are mated with each other.

As understood from FIGS. 1, 9 and 14 to 20, the two spring accommodation portions 220 of the connector 100 accommodate the two spring portions 520, respectively, of the mating connector 400 when the connector 100 and the mating connector 400 are mated with each other. The protrusion portion 234 of the connector 100 is received in the groove 540 of the mating connector 400 when the connector 100 and the mating connector 400 are mated with each other.

As understood from FIGS. 1, 9 and 14 to 20, when the connector 100 and the mating connector 400 are mated with each other, the contact portion 305 of the contact 300 of the connector 100 is brought into contact with the upper contact portions 612 and the lower contact portions 616 of the mating contact 600 of the mating connector 400. More specifically, when the connector 100 and the mating connector 400 are mated with each other, an upper surface of the contact portion 305 of the contact 300 of the connector 100 is brought into contact with the upper contact points 614 of the upper contact portions 612 of the mating contact 600 of the mating connector 400, and a lower surface of the contact portion 305 of the contact 300 of the connector 100 is brought into contact with the lower contact points 618 of the lower contact portions 616 of the mating contact 600 of the mating connector 400.

While the present invention has been described with specific embodiments, the present invention is not limited to the aforementioned embodiments.

Although the connector 100 of the aforementioned embodiment has the single protrusion portion 234 and the two lock portions 232, the connector 100 may have two protrusion portions and a single lock portion which is positioned between the two protrusion portions. In this case, it is, however, necessary for the two protrusion portions to be arranged so that a user's finger can be prevented from being brought into contact with the contact 300 by the user's finger abutting against the two protrusion portions when the user's finger is inserted into the receiving portion 250.

In the connector 100 of the aforementioned embodiment, each of the lock portions 232 pierces the upper wall 230 in the up-down direction. Each of the lock portions, however, may not pierce an upper surface of the upper wall 230 in the up-down direction, provided that the lock portions receive the mating lock portions 510, respectively. In other words, the lock portion 232 may be a recess which is recessed upward.

In the connector assembly 10 of the aforementioned embodiment, each of the lock portions 232 is the hole which pierces the upper wall 230 in the up-down direction while each of the mating lock portions 510 is the protrusion which protrudes upward. However, the lock portion 232 may be a protrusion which protrudes downward in the up-down direction while the mating lock portion 510 may be a hole, which pierces the spring portion 520 in the up-down direction, or may be a recess which is recessed downward.

Although the connector 100 of the aforementioned embodiment is connectable with the cable 700, the connector 100 may be mountable on a circuit board (not shown). In this case, the contact 300 of the connector 100 may have a terminal portion for surface mount technology (SMT) or may have a terminal portion for through-hole technology (THT).

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a front-rear direction, wherein:

the mating connector has a mating lock portion;

the connector comprises a housing and a contact;

the housing has an upper wall and a lower wall;

the housing forms a receiving portion;

the receiving portion receives the mating connector when the connector and the mating connector are mated with each other;

the contact is held by the housing;

the contact protrudes in the receiving portion;

the receiving portion is positioned between the upper wall and the lower wall in an up-down direction perpendicular to the front-rear direction;

an inner surface of the upper wall is provided with a lock portion and a protrusion portion;

when the connector and the mating connector are mated with each other, the lock portion locks the mating lock portion to lock a mating of the connector with the mating connector;

the protrusion portion protrudes downward in the up-down direction;

the inner surface of the upper wall is provided with at least two of the lock portions; and the protrusion portion is positioned between the at least two lock portions in a lateral direction perpendicular to both the front-rear direction and the up-down direction.

2. The connector as recited in claim 1, wherein the lock portion is a hole which is configured to receive the mating lock portion.

3. The connector as recited in claim 1, wherein:

the contact has an end in the front-rear direction; and the end of the contact is provided with an insulating portion.

4. The connector as recited in claim 3, wherein:

the housing is formed with a holding portion;

the holding portion extends in the front-rear direction in the receiving portion and holds the contact; and the insulating portion is a part of the holding portion.

5. The connector as recited in claim 1, wherein the contact has a flat shape.

6. The connector as recited in claim 1, wherein:

the mating connector further has a spring portion;

the mating lock portion is supported by the spring portion;

the housing has a spring accommodation portion;

the spring accommodation portion accommodates the spring portion when the connector and the mating connector is mated with each other; and the spring accommodation portion and the protrusion portion are arranged in a lateral direction perpendicular to both the front-rear direction and the up-down direction.

7. A connector assembly comprising the connector as recited in claim 1 and the mating connector.

8. A connector assembly comprising a connector and a mating connector, wherein:

the connector is mateable with the mating connector along a front-rear direction;

the mating connector has a mating lock portion;

the connector comprises a housing and a contact;

the housing has an upper wall and a lower wall;

the housing forms a receiving portion;

the receiving portion receives the mating connector when the connector and the mating connector are mated with each other;

the contact is held by the housing;

the contact protrudes in the receiving portion;

the receiving portion is positioned between the upper wall and the lower wall in an up-down direction perpendicular to the front-rear direction;

an inner surface of the upper wall is provided with a lock portion and a protrusion portion;

when the connector and the mating connector are mated with each other, the lock portion locks the mating lock portion to lock a mating of the connector with the mating connector;

the protrusion portion protrudes downward in the up-down direction;

the mating connector has two of the mating lock portions, two spring portions and a coupling portion;

the two spring portions support the two mating lock portions, respectively;

the coupling portion couples the two spring portions with each other;

the two spring portions are positioned away from each other in a lateral direction perpendicular to both the front-rear direction and the up-down direction;

the housing has two spring accommodation portions;

when the connector and the mating connector are mated with each other, the two spring accommodation portions accommodate the two spring portions, respectively; and the protrusion portion is positioned between the two spring accommodation portions in the lateral direction.

* * * * *